US005389903A

United States Patent [19]

Piirainen

[11] Patent Number: 5,389,903

[45] Date of Patent: Feb. 14, 1995

[54] COMB-LINE HIGH-FREQUENCY BAND-PASS FILTER HAVING ADJUSTMENT FOR VARYING COUPLING TYPE BETWEEN ADJACENT COAXIAL RESONATORS

[75] Inventor: Risto Piirainen, Oulu, Finland

[73] Assignee: Nokia Telecommunications Oy, Espoo, Finland

[21] Appl. No.: 75,579

[22] PCT Filed: Dec. 16, 1991

[86] PCT No.: PCT/FI91/00387

§ 371 Date: Jun. 16, 1993

§ 102(e) Date: Jun. 16, 1993

[87] PCT Pub. No.: WO92/11664

PCT Pub. Date: Jul. 9, 1992

[30] Foreign Application Priority Data

Dec. 17, 1990 [FI] Finland ..... 906215

[51] Int. Cl.[6] ..... H01P 1/205

[52] U.S. Cl. ..... 333/203; 333/206; 333/207

[58] Field of Search ..... 333/202, 203, 206, 207, 333/222–226, 235

[56] References Cited

U.S. PATENT DOCUMENTS

| | | | |
|---|---|---|---|
| 3,496,498 | 2/1970 | Kawahashi et al. | 333/210 |
| 3,840,828 | 10/1974 | Linn et al. | 333/202 |
| 4,020,428 | 4/1977 | Friend et al. | 333/203 |
| 4,059,815 | 11/1977 | Makimoto et al. | 333/202 X |
| 4,216,448 | 8/1980 | Kasuga et al. | 333/206 X |
| 4,224,587 | 9/1980 | Makimoto et al. | 333/205 |
| 4,283,697 | 8/1981 | Masuda et al. | 333/203 X |
| 4,284,966 | 8/1981 | Wanat | 333/202 |
| 4,292,610 | 9/1981 | Makimoto et al. | 333/207 X |
| 4,757,289 | 7/1988 | Kosugi et al. | 333/209 |

FOREIGN PATENT DOCUMENTS

| | | |
|---|---|---|
| 0038996 | 11/1981 | European Pat. Off. . |
| 2452743 | 5/1975 | Germany . |
| 2726797 | 12/1977 | Germany . |
| 2726798 | 12/1977 | Germany . |

*Primary Examiner*—Seungsook Ham
*Attorney, Agent, or Firm*—Cushman Darby & Cushman

[57] ABSTRACT

A high-frequency bandpass filter, including several cylindrical conductor rods (3, 4) arranged in a line with predetermined spacings in a continuous space defined by an elongated housing (1) made of an electrically conductive material and closed on all sides, each conductor rod being attached and short-circuited at its first end to the housing (1) and spaced apart from the housing at its second end so that each conductor rod forms a coaxial resonator together with the housing. The second end of each conductor rod includes a portion (4) larger in diameter as compared with the remaining portion of the conductor rod, and the type of a coupling between two adjacent coaxial resonators is arranged to be set to be predominantly capacitive or predominantly inductive by adjusting the ratio of the distance between the first ends of the conductor rods (3, 4) of the coaxial resonators to a distance between the portions (4) with a larger diameter.

12 Claims, 2 Drawing Sheets

FIG. 1
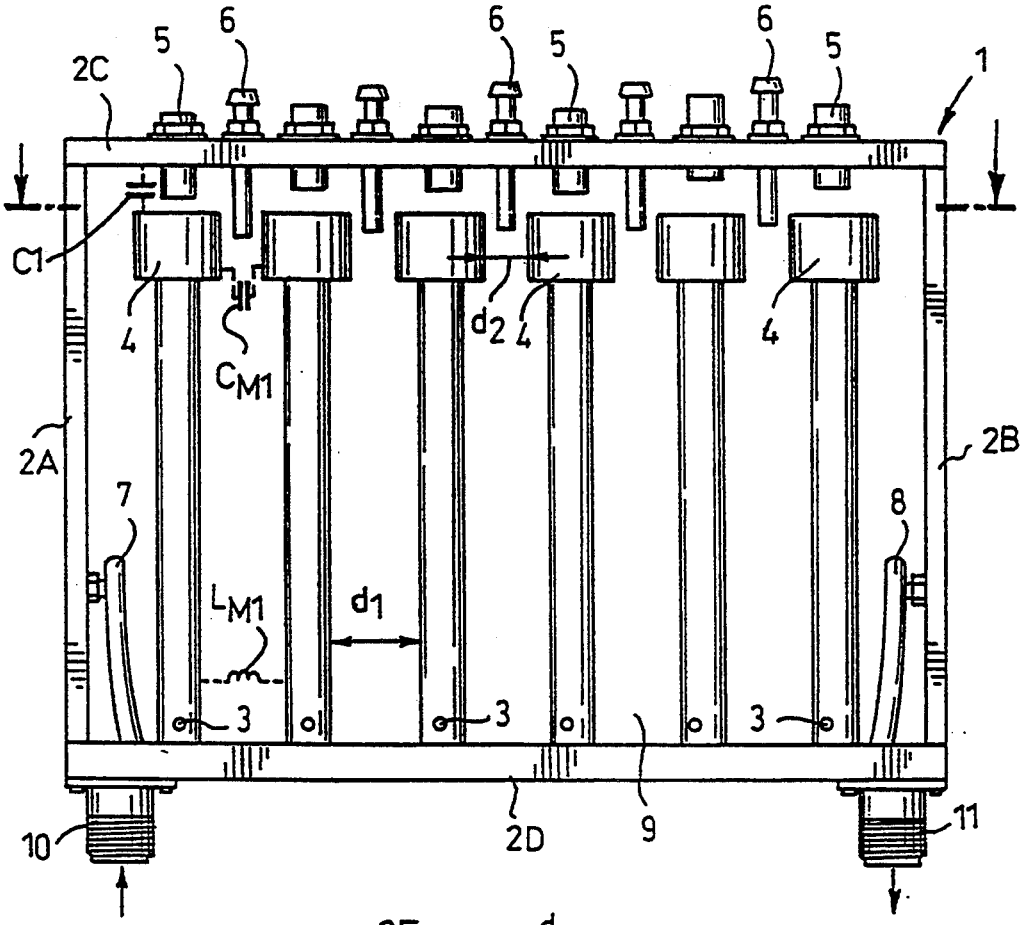
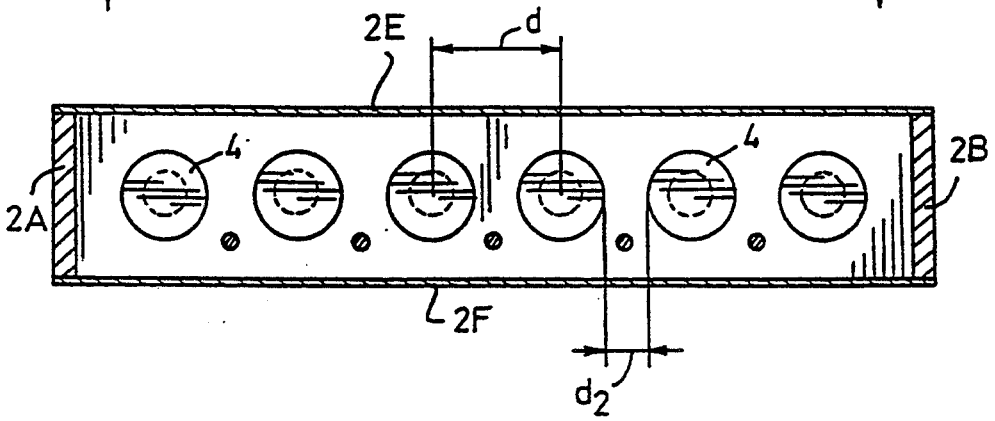
FIG. 2

FIG. 3
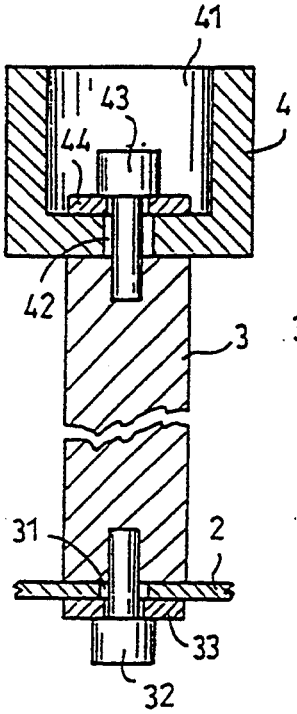
FIG. 4
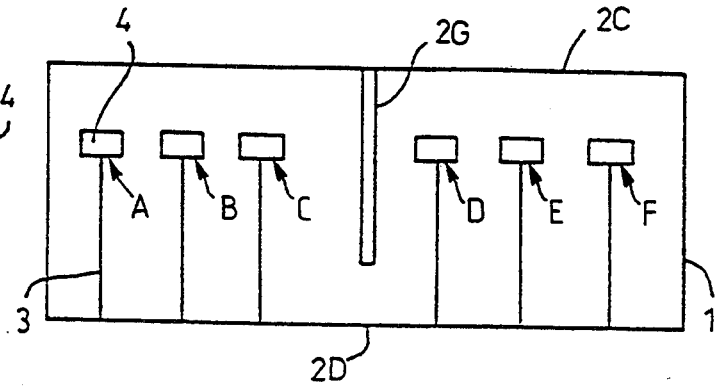
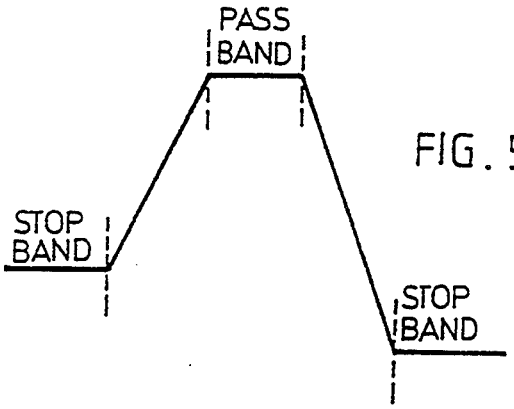
FIG. 5
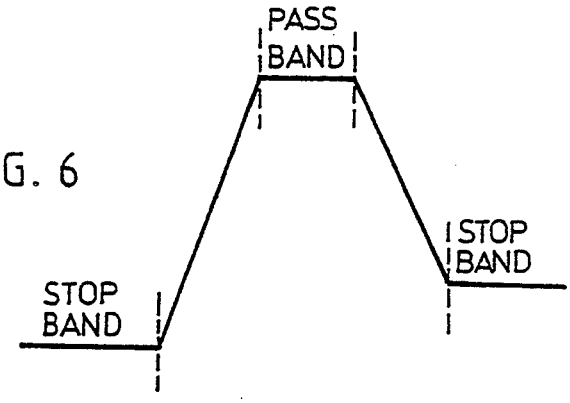
FIG. 6

COMB-LINE HIGH-FREQUENCY BAND-PASS FILTER HAVING ADJUSTMENT FOR VARYING COUPLING TYPE BETWEEN ADJACENT COAXIAL RESONATORS

BACKGROUND OF THE INVENTION

The invention relates to a high-frequency bandpass filter, comprising several cylindrical conductor rods arranged in a line with predetermined spacings in a continuous space defined by an elongated housing made of an electrically conductive material and closed on all sides, each conductor rod being attached and short-circuited at its first end to the housing and spaced apart from the housing at its second end so that each conductor rod forms a coaxial resonator together with the housing.

In a typical high-frequency bandpass filter of the type described above, the conductor rods in the metal housing are separated from each other by partition walls into separate compartments each forming a coaxial resonator. The coupling between adjacent resonators is accomplished either by means of separate coil structures inductively at the short-circuited end of the resonators or by means of separate capacitor structures at the open end of the resonators. Another common practice is to realize each coaxial resonator by means of a conductor rod positioned in a fully separate metal box. The coupling between the resonators is again accomplished, e.g., by separate coil structures, such as a conductor wire running from one resonator box to another through coupling openings. Prior art filter structures of this type are large in size and complicated, in addition to which they require plenty of manual work and are difficult to tune, as a result of which a sufficiently accurate reproducibility of the desired filter properties is also difficult to achieve in series production. For instance, when using the above-mentioned conductor wire coil, the coupling between the resonators has to be adjusted by bending the conductor wire coil.

Another known filter type is the so-called Comb-Line filter, in which all conductor rods are placed, in place of separate metal boxes or compartments separated from each other by partition walls, in a single continuous space defined by a housing, so that an open filter structure is achieved, in which the couplings between the resonators are formed directly by the couplings between the conductor rods of the resonators. Therefore the filter is smaller in size and simpler than the filters described above. In this type of filter, the couplings between the conductor rods are controlled by means of adjustment screws provided in the cover of the housing and by varying the distances between the conductor rods; such adjustments, however, cannot provide different filter responses by one and the same filter unit for different applications.

SUMMARY OF THE INVENTION

The object of the present invention is to provide a high-frequency bandpass filter which is smaller in size, simpler in structure and easier to tune than previously.

This is achieved by means of a high-frequency bandpass filter of the type described in the introduction, which according to the invention is characterized in that the second end of each conductor rod comprises a portion larger in diameter as compared with the remaining portion of the conductor rod, and that the type of a coupling between any two adjacent coaxial resonators is arranged to be set to be predominantly capacitive or predominantly inductive by adjusting the ratio of a distance between the first ends of the conductor rods of the coaxial resonators to a distance between said portions with a larger diameter.

In the invention, the unconnected end of the conductor rod, that is, its open end, is provided with a knob having a diameter larger than that of the shaft portion of the conductor rod, which strengthens the capacitive coupling between adjacent conductor rods. As the capacitive portion in the coupling of adjacent resonators depends on the distance between the knobs and the inductive portion depends on the distance between the shaft portions, either a capacitive or an inductive coupling can be made predominant by varying the ratio between the two distances. As the type (inductive or capacitive) of couplings between the resonators affects the location of the stop bands of the filter, different combinations of capacitive and inductive couplings can provide different filter responses having stop bands symmetrical or asymmetrical with respect to each other above and below the pass band. The expression asymmetrical stop bands means that one stop band is steeper than the other. In cases where only one stop band with a steep slope is required, the filter according to the invention can be accomplished with a smaller volume than a symmetrical filter having a corresponding Q value.

In the filter according to the invention, the volume efficiency ratio (the ratio of the electric properties of the filter to its volume) is further improved by a controlled skip of a signal from one resonator over another resonator to a third resonator, which property is achieved by using the cylindrical knob according to the invention.

In a preferred embodiment of the invention, the conductor rod comprises a cylindrical shaft portion a first end of which is attached to the housing so that the point of attachment is displaceable longitudinally of the filter so as to adjust the distance between the conductor rods, and a cylindrical knob portion having a larger diameter and arranged to be attached to a second end of the shaft portion concentrically or eccentrically in an adjustable way. The response of the filter is easy to set as desired by adjusting the point of attachment of the shaft portion and the eccentricity between the shaft portion and the knob. These adjustments can be carried out in a special installation or adjustment jig, which enables a very high accuracy and reproducibility in series production.

BRIEF DESCRIPTION OF THE DRAWINGS

The invention will now be described in greater detail with reference to the drawings, in which:

FIG. 1 is a schematic cross-sectional view of the mechanical structure of a bandpass filter according to the invention;

FIG. 2 is a top view of the bandpass filter shown in FIG. 1 seen in a cross-section along the line A—A shown in FIG. 1;

FIG. 3 is a cross-sectional view of the structure of a conductor rod suitable for use in the filter according to the invention and the attachment of the rod to a housing;

FIG. 4 illustrates schematically the structure of another bandpass filter according to the invention; and FIGS. 5 and 6 illustrate filter responses to be obtained by the bandpass filter according to the invention.

DETAILED DESCRIPTION

Referring to FIGS. 1 and 2, the high-frequency bandpass filter comprises a rectangular, elongated housing closed on all sides and comprising end plates 2A and 2B, a cover plate 2C, a bottom plate 2D and side plates 2E and 2F. The housing may be made of a metal sheet or an insulator sheet coated with an electrically conductive material. The metal housing may also be coated with another metal, such as copper, to improve the properties of the filter. The plates 2A to 2F forming the housing define therebetween a continuous space 9 extending substantially over the entire length of the housing. The space 9 accommodates six cylindrical conductor rods arranged in a line with predetermined spacings, each conductor rod being attached and short-circuited at its lower end to the bottom plate 2D of the housing and being spaced at its upper end apart from the cover plate 2C of the housing, so that the conductor rod forms a coaxial resonator together with the housing, in which resonator the conductor rod is the inner conductor and the housing is the outer conductor. Each conductor rod comprises a cylindrical shaft portion 3, preferably a rod or pipe of copper, having its lower end attached to the bottom plate 2D of the housing, and a cylindrical knob portion 4 preferably made of copper and attached to the upper end of the shaft portion 3 and having a diameter larger than that of the shaft portion 3.

The structure of the conductor rod and its attachment to the bottom plate 2D of the housing is illustrated in more detail in FIG. 3, in which the lower end of the shaft portion 3 is attached to the bottom plate by means of a mounting screw 32, which is mounted from outside the housing through a mounting hole 31 in the bottom plate 2D into an internally threaded hole in the lower end of the shaft portion. The mounting hole 31 in the bottom plate 2D is larger in diameter than the mounting screw 32 at least in the longitudinal direction of the bottom plate, so that the point of attachment of the shaft portion 3 in the bottom plate can be displaced within the limits allowed by the mounting hole 31 in the longitudinal direction of the filter so as to adjust the distances between the conductor rods. A washer 33 having a diameter larger than that of the mounting hole 31 is provided between the head of the screw 32 and the bottom plate 2D. The cylindrical knob 4 comprises a mounting hole 42 extending axially through it, through which mounting hole a mounting screw driven into an internally threaded mounting hole in the upper end of the shaft portion 3 mounts the knob 4 to the shaft portion 3. The diameter of the mounting hole 42 is larger than the diameter of the mounting screw 43, which enables the knob portion 4 to be displaced at the mounting stage radially with respect to the shaft portion 3 so as to mount it concentrically or with a desired degree of eccentricity with respect to the shaft portion. By adjusting the eccentricity between the shaft portion 3 and the knob 4, the distance between the knobs 4 of adjacent conductor rods can be adjusted. In the embodiment of FIG. 3, a washer larger in diameter than the mounting hole 42 is provided between the head of the screw 43 and the knob 4. In addition, the upper surface of the knob 4 is provided with a recess 41 for the head of the screw 43 and the washer 44, the recess providing space for the radial adjustment described above.

Referring again to FIG. 1, a metal tuning screw 5 extending into the inner space 9 of the housing 1 is provided in the cover 2C of the housing above the knob 4. The distance of the lower end of the tuning screw 5 from the upper surface of the knob 4 determines the level of ground capacitance C1 between the housing and the knob 4, illustrated by a capacitor C1 drawn by a broken line. By means of the tuning screw 5, the ground capacitance and thus the resonance frequency of an individual resonator can be adjusted. The cover plate 2C of the housing 1 further comprises a metal tuning screw 6 extending into the housing within the area between two adjacent conductor rods. This tuning screw enables the fine adjustment of the capacitance between the knobs 4 of any two adjacent conductor rods and thus the coupling between adjacent resonators. In the embodiment shown in FIG. 1, the input of the filter is formed by a wire loop 7 extending into the housing 1 through an inlet 10 provided in the bottom plate 2D, the end of the wire loop within the housing being connected to the bottom plate 2D. The wire loop 7 is positioned in a space between one end plate 2A of the housing and the conductor rod closest to it. Correspondingly, the output of the filter is formed by a wire loop 8 extending through an inlet 11 into a space between the opposite end plate 2B and the conductor rod closest to it, one end of the wire loop 8 being connected to the bottom plate 2D. The wire loops 7 and 8 form coils which are coupled inductively to the shaft portion 3 of the closest conductor rod. As appears from the above, the invention provides an open Comb-Line type filter structure in which the couplings between the resonators are formed directly by the inductive and/or capacitive couplings between the conductor rods 3, 4 of the resonators, as is illustrated by capacitors $C_{M1}$ and a coil $L_{M1}$ drawn by broken lines. The capacitive coupling or the inductive coupling can be set as predominant in the coupling between two adjacent coaxial resonators by adjusting the ratio of a distance d1 between the shaft portions 3 of the conductor rods of the coaxial resonators to a distance d2 between the knobs 4. This adjustment can be accomplished e.g. in the conductor rod structure shown in FIG. 3 by adjusting the point of attachment of the shaft portion 3 to the bottom plate 2D so as to vary the distance d1, whereas the distance d2 is varied by adjusting the eccentricity between the knob 4 and the shaft portion 3. Generally speaking, the capacitive coupling $C_{M1}$ between the knobs 4 becomes predominant as the distance d2 decreases. This coupling can be fine adjusted by the tuning screw 6.

In the filter according to the invention, both couplings in which the capacitive coupling is predominant and couplings in which the inductive coupling is predominant can be used as a combination dependent on the shape of the desired filter response. In this way different filter responses can be obtained, in which the upper and lower stop band of the filter may be symmetrical or asymmetrical with respect to each other.

The shaping of the response of the filter according to the invention is illustrated in FIGS. 4, 5 and 6. FIG. 4 shows schematically the structure of the filter according to the invention, comprising six resonators indicated with the symbols A, B, C, D, E and F in that order from the filter input to the filter output. The filter structure shown in FIG. 4 is otherwise similar to that shown in FIGS. 1 to 3 except for a partition wall 2G intended to strengthen the structure of the housing 1. The partition wall 2G extends from the cover plate 2C of the housing 1 downward between the resonators C and D over a portion of the height of the housing 1 so that a gap remains between the partition wall 2G and the bottom plate 2D, through which gap an inductive coupling can be established between the resonators C and D and which joins the spaces on opposite sides of the partition wall into a continuous space. Even though the partition wall 2G is primarily intended only to stiffen the structure of the housing 1, it inevitably also affects the coupling between the resonators C and D by preventing the capacitive coupling, so that the inductive coupling is predominant. In this special case, it is not, of course, possible to adjust the capacitive coupling between the resonators C and D by varying the distance between the knobs 4. This naturally has to be taken into account in the design of the filter, but the partition wall does not in any other way affect the structure and properties of the filter according to the invention. In place of the partition wall 2G, it would be possible to use a partition wall extending from the bottom plate 2D upward over a portion of the height of the housing 1. This partition wall would make the capacitive coupling predominant between the resonators C and D, which should again be taken into account in the electric design of the filter.

FIG. 5 illustrates a filter response to be obtained by the filter shown in FIG. 4 when the capacitive coupling is predominant between the resonators D and E and the resonators E and F, and the inductive coupling is predominant in the other couplings between the resonators. In FIG. 5, the stop bands above and below the pass band are asymmetrical with respect to each other so that the stop band above the pass band has a steeper slope than the stop band below the pass band.

FIG. 6 shows a filter response to be obtained by means of the filter shown in FIG. 4 when the capacitive coupling is predominant between the resonators B and C and between the resonators E and F, and the inductive coupling is predominant in the other couplings between the resonators. FIG. 6 also illustrates an asymmetrical filter response in which the stop band below the pass band has a steeper slope than the stop band above the pass band. The ratio of the length of the shaft portion of the conductor rod to the height of the knob 4 is preferably within the range from 6.5 to 7.5. The ratio of the diameter of the shaft portion 3 of the conductor rod to the diameter of the knob 4 is preferably within the range from 0.5 to 0.6. The capacitive coupling is predominant when the ratio d1:d2 is from 2.8 to 3.0, and the inductive coupling is predominant when the ratio d1:d2 is from 2.2. to 2.4.

The figures and the description related to them are only intended to illustrate the present invention. In its details the bandpass filter according to the invention can be modified within the scope of the attached claims.

I claim:

1. A comb-line bandpass filter, comprising:

an outer conductor in form of an elongated housing made of an electrically conductive material, a plurality of inner conductors in form of respective conductor rods arranged in a line and spaced apart from each other within said housing so that each of said inner conductors provides a coaxial resonator together with said outer conductor, each of said inner conductors comprising:

a cylindrical smaller diameter portion, one end of said smaller diameter portion being connected by a connection to said housing, a cylindrical larger diameter portion attached to another end of said smaller diameter portion, means for adjusting an axial offset between said smaller diameter portion and said larger diameter portion so as to vary a type of a coupling between any two adjacent ones of said coaxial resonators between predominantly capacitive and predominantly inductive couplings by varying the ratio of a distance between the smaller diameter portions of inner conductors of said two adjacent ones of said coaxial resonators to a distance between the larger diameter portions of said inner conductors of said two adjacent ones of said coaxial resonators.

2. A filter according to claim 1, wherein:

said filter comprises predominantly inductive coupling between at least one pair of adjacent coaxial resonators and predominantly capacitive coupling between at least one other pair of adjacent coaxial resonators as a combination dependent on a desired shape of a pass band to be provided by use of said filter.

3. A filter according to claim 1, wherein:

the connection of the first end of the smaller diameter portion of each inner conductor to the housing is adjustable in order to adjust the distances between said inner conductors.

4. A filter according to claim 2, wherein:

the connection of the first end of the smaller diameter portion of each inner conductor to the housing is adjustable in order to adjust the distances between said inner conductors.

5. A filter according to claim 1, wherein:

the filter comprises six of said conductor rods.

6. A filter according to claim 2, wherein:

the filter comprises six of said conductor rods.

7. A filter according to claim 1, wherein:

said conductors are arranged to provide upper and lower stop bands which are asymmetrical with respect to each other.

8. A filter according to claim 2, wherein:

said conductors are arranged to provide upper and lower stop bands which are asymmetrical with respect to each other.

9. A filter according to claim 1, further including:

a respective tuning screw projecting into the housing provided in a wall of the housing above corresponding cylindrical larger diameter portions of said conductor rods, for adjusting ground capacitance between the respective said cylindrical larger diameter portion and the housing and thereby the resonance frequency of the respective resonator.

10. A filter according to claim 2, further including:

a respective tuning screw projecting into the housing provided in a wall of the housing above corresponding cylindrical larger diameter portions of said conductor rods, for adjusting ground capacitance between the respective said cylindrical larger diameter portion and the housing and thereby the resonance frequency of the respective resonator.

11. A filter according to claim 1, further including:

a respective tuning screw projecting into the housing provided between respective pairs of said conductor rods in a wall of the housing above said cylindrical larger diameter portions of the respective said conductor rods, for adjusting coupling between the respective said resonators.

12. A filter according to claim 2, further including:

a respective tuning screw projecting into the housing provided between respective pairs of said conductor rods in a wall of the housing above said cylindrical larger diameter portions of the respective said conductor rods, for adjusting coupling between the respective said resonators.

* * * * *